United States Patent [19]

Calhoun et al.

[11] 4,354,554

[45] Oct. 19, 1982

[54] WELL SAFETY VALVE

[75] Inventors: Michael B. Calhoun, Carrollton, Tex.; Robert L. Holland, Jr., Ventura, Calif.; Paul D. Scott, Carrollton, Tex.

[73] Assignee: Otis Engineering Corporation, Dallas, Tex.

[21] Appl. No.: 142,096

[22] Filed: Apr. 21, 1980

[51] Int. Cl.[3] ..... E21B 34/10; E21B 34/16; E21B 43/12

[52] U.S. Cl. ..... 166/321; 166/105.5; 166/106; 166/152; 166/322; 166/332

[58] Field of Search ..... 166/321, 322, 332, 334, 166/129, 183, 188, 142, 149, 152, 106, 105.5, 278, 316, 319, 333, 364; 175/60, 67, 215

[56] References Cited

U.S. PATENT DOCUMENTS

| | | | |
|---|---|---|---|
| 2,786,535 | 3/1957 | Boer et al. | 166/142 |
| 2,798,561 | 7/1957 | True | 166/321 |
| 3,375,874 | 4/1968 | Cherry et al. | 166/321 X |
| 3,786,863 | 1/1974 | Tausch | 166/322 X |
| 3,830,296 | 8/1974 | Shirley | 166/321 X |
| 3,913,676 | 10/1975 | Barbee, Jr. et al. | 166/278 |
| 4,049,052 | 9/1977 | Arendt | 166/321 X |
| 4,086,935 | 5/1978 | Raulins et al. | 166/321 X |
| 4,271,903 | 6/1981 | Slagle et al. | 166/322 X |

*Primary Examiner*—Stephen J. Novosad
*Attorney, Agent, or Firm*—H. Mathews Garland

[57] ABSTRACT

A wire line removable well safety valve in an oil and gas well completion design including a tubing string, a well packer around the tubing string sealing with the well casing, and a submergible well pump on the tubing string below the packer. The safety valve controls flow of pumped well fluids through the tubing string, directs separated gas into the casing annulus around the tubing string above the packer, and shuts off the flow of pumped fluids and separated gas to the surface while permitting recirculation of pumped well fluids between the annulus and tubing string below the packer. The safety valve includes a housing having separate central and annular flow passages for pumped fluids and separated gas, respectively, a ball valve for controlling flow of pumped fluids in the central flow passage, an annular bypass valve for controlling flow of separated gas along the annular flow passage, and a recirculating valve between the central and annular flow passages for recirculation of pumped fluids when the ball and bypass valves are closed. The safety valve is held open hydraulically from the surface and includes means for closing the valve when hydraulic pressure fails, shutting off the flow of pumped fluids and bypass gas while permitting continuous operation of the well pump by recirculating pumped fluids below the packer.

20 Claims, 17 Drawing Figures

WELL SAFETY VALVE

This invention relates to safety valves used in oil and gas wells and more particularly to a safety valve employed in wells equipped with submergible pumps.

Oil and gas wells in producing formations which do not have sufficient pressure to flow the wells are equipped with pumps for raising the oil to the surface. Such wells are found in fields which inherently have low formation pressure and in fields which have been produced over a sufficient period of time to deplete the formation pressure necessary to displace the oil and gas to the surface. A typical well completion including a submergible pump is illustrated at page 9 of Otis Engineering Corporation Catalog 0EC5121 entitled Wireline Completion Equipment and Subsurface Safety Systems published in June 1976. Such well completion includes a safety valve which is hydraulically controlled from the surface for shutting off flow of oil in the tubing string and gas in the tubing string-casing annulus in the event of any emergency which affects the hydraulic pressure in the control system. In such a system when the safety valve closes shutting in the well it is preferred that the submergible pumps be able to continue to operate circulating the well fluids through the pump below the packer. In order to permit the pump to continue to operate the presently available equipment for such well completions includes a longitudinally movable lower seal on the safety valve apparatus which moves across a lateral port above the pump in the safety valve housing changing the safety valve apparatus from a producing mode to a shut in recirculating mode. Moving the lower seal across the port is damaging to the lower seal resulting in premature seal failure requiring increased safety valve maintenance. Pulling and rerunning the safety valve is time consuming and expensive.

It is a principal object of the invention to provide a new and improved safety valve for use in oil and gas wells.

It is another object of the invention to provide a new and improved safety valve for use in oil and gas well completions including submergible pumps.

It is another object of the invention to provide a safety valve for use with a pump in an oil and gas well to permit continuous operation of the pump when the well is shut-in.

It is another object of the invention to provide a well safety valve of the character described which permits a well pump to recirculate well fluids in a well bore below a packer when the well is shut-in.

It is another object of the invention to provide a well safety valve for use with a submergible well pump which shuts off the flow of well fluids to the surface under emergency conditions directing the well fluids below a packer along paths permitting the pump to operate continuously recirculating well fluids back to the well bore below the packer.

It is another object of the invention to provide a well safety valve which includes valve apparatus for shifting the safety valve from a producing mode to a shut-in recirculating mode without moving a seal across an open port.

It is another object of the invention to provide a well safety valve which changes from a producing mode to a recirculating mode with a minimum of seal wear.

It is another object of the invention to provide a well safety valve which controls the flow of well fluids along both a central bore and a separate annular flow passage around the central bore for conducting pumped liquids along the central bore and separated gas along the annular flow passage.

In accordance with the invention there is provided a well safety valve having a tubular housing provided with separate longitudinal central and annular flow passages, a first valve in the central flow passage, a second valve in the annular flow passage, and a third recirculating valve between the central and annular flow passages, the recirculating valve being adapted to close when the first and second valves are open and to open when the first and second valves are closed. The well safety valve is run into a tubing string through a well packer above a submergible pump for controlling flow from the pump through the central flow passage of the well valve into the tubing string and flow of separated gas below the packer into the annular flow passage of the safety valve past the packer into the tubing-casing annulus above the packer. Closure of the safety valve shuts off flow in both the central and annular flow passages of the well valve and directs pumped fluid below the packer through recirculating passages from the pump back into the well bore below the packer.

The foregoing objects and advantages of the invention will be better understood from the following detailed description of a preferred embodiment thereof taken in conjunction with the accompanying drawings wherein.

Figure 3A:
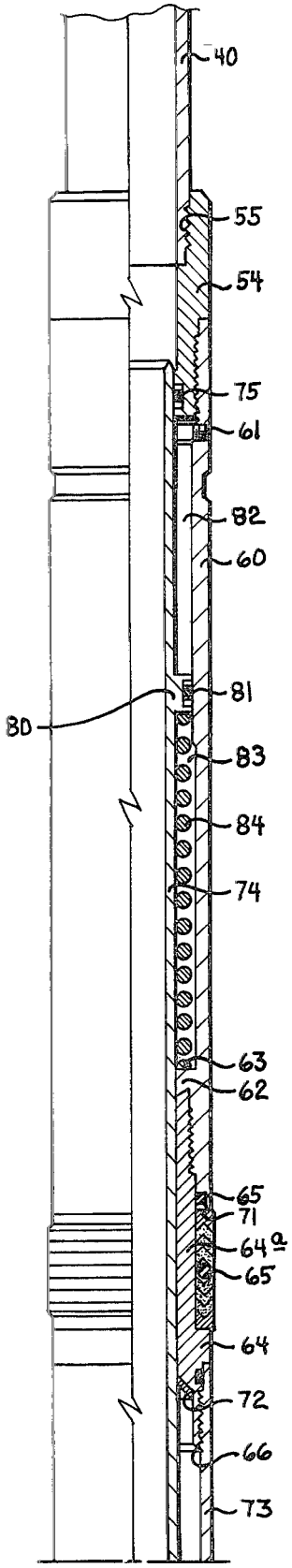
Figure 3B:
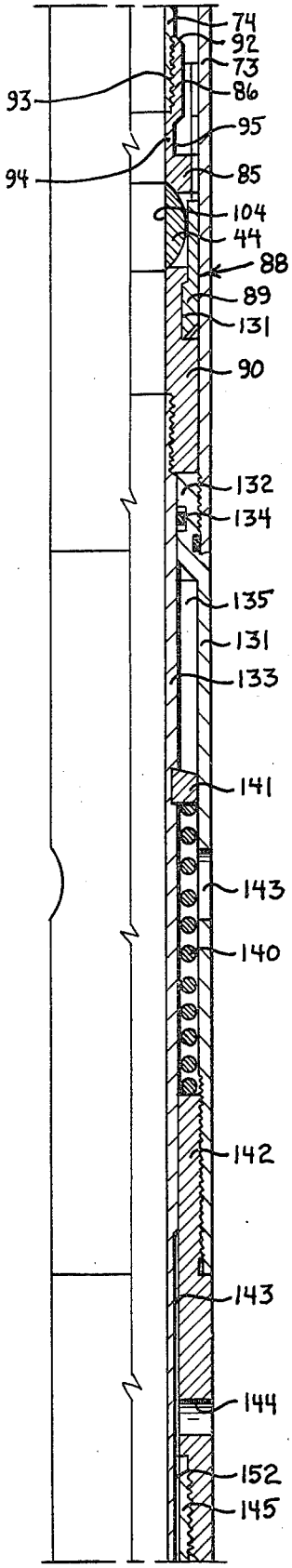
Figure 3C:
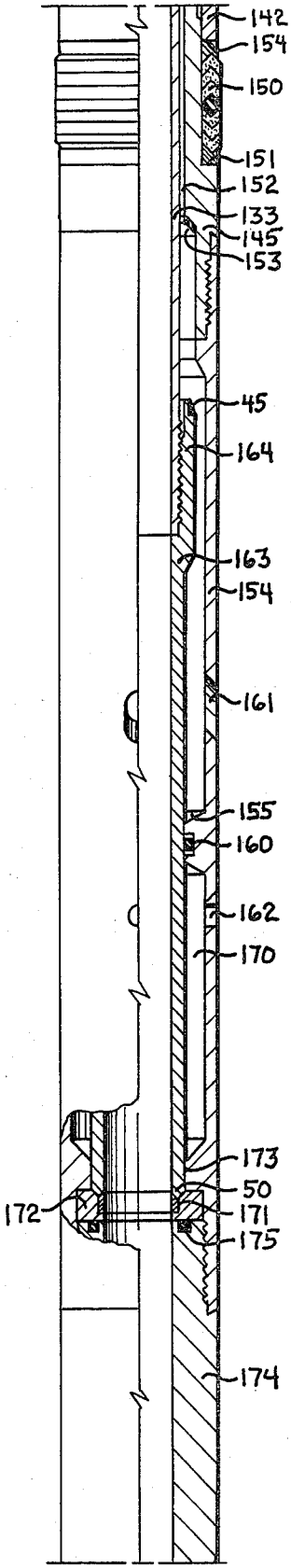
Figure 3D:
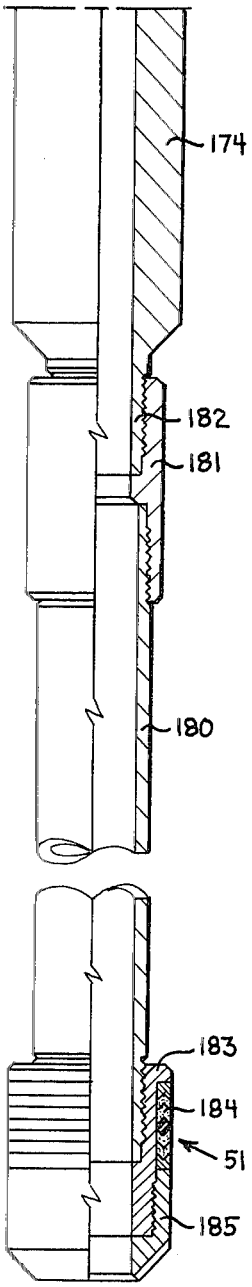
Figure 4A:
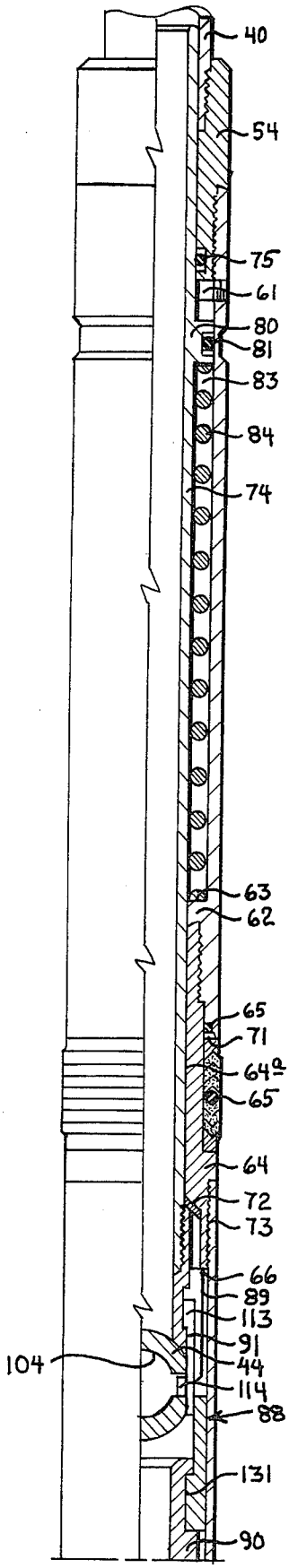
Figure 4B:
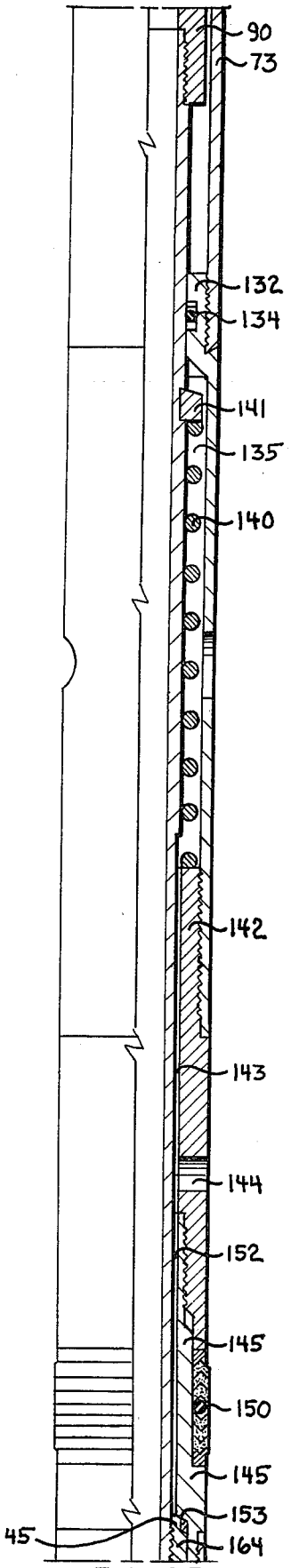
Figure 4C:
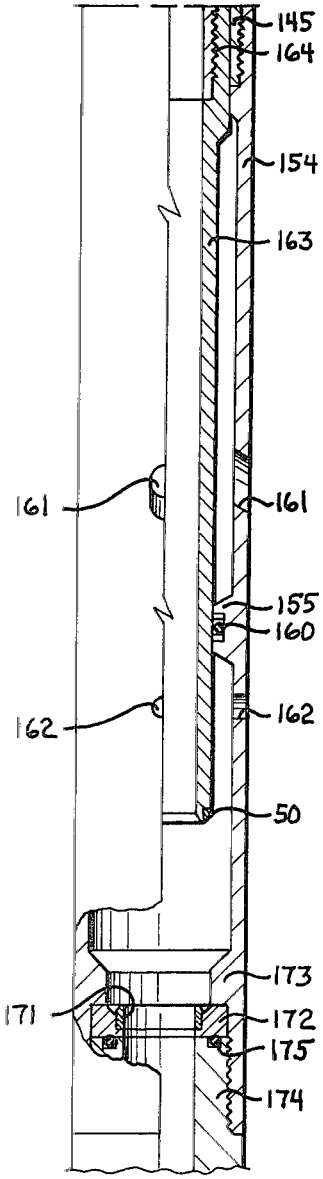
Figure 5:
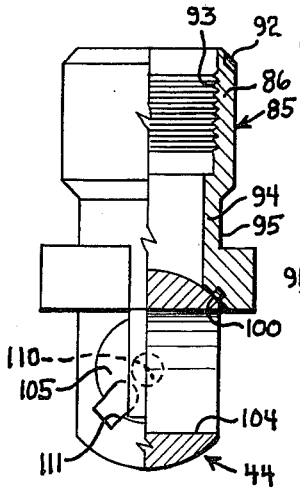
Figure 8:
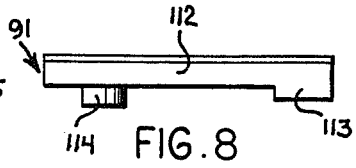
Figure 9:
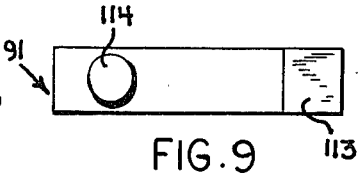
Figure 6:
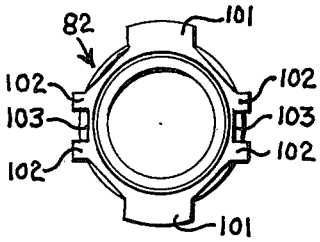
Figure 10:
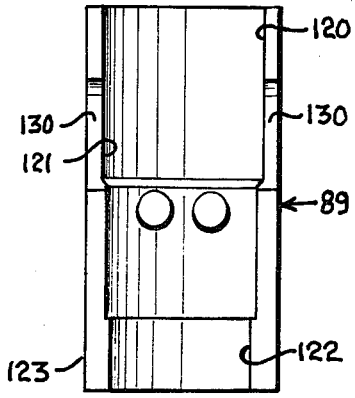
Figure 7:
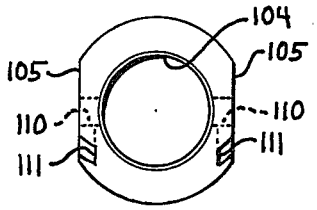
Figure 11:
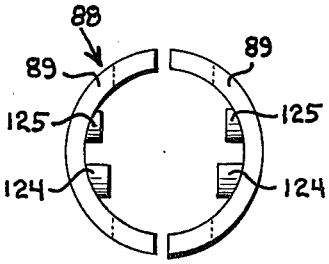
Figure 12:
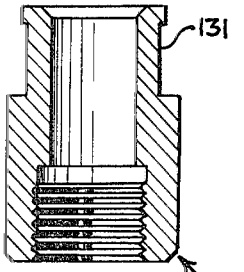

FIGS. 3A–3D taken together form a longitudinal view in section and elevation of the well safety valve of the invention illustrated in the open producing mode;

FIGS. 4A–4C taken together form a longitudinal view in section and elevation of the well safety valve of the invention rotated 90 degrees from the view of FIGS. 3A–3D and showing the valve closed in the recirculating mode;

FIG. 5 is a side view in section and elevation of the upper seat and ball valve of the well safety valve;

FIG. 6 is a lower end view in elevation of the upper ball valve seat;

FIG. 7 is an end view in elevation of the ball valve of the well safety valve showing the bore through and the milled operator pin slots in the ball valve;

FIG. 8 is an inside view in elevation of one of the ball valve operator arms;

FIG. 9 is a top edge view of the ball valve operator arm as seen in FIG. 8;

FIG. 10 is an inside view in elevation of one of the outer cage halves of the ball valve;

FIG. 11 is an end view of the two ball valve sleeves looking at the lower ends of the sleeves in relative positions of the sleeves when in operating relationship with the ball valve; and FIG. 12 is a longitudinal view in section of the lower ball valve seat.

Figure 1:
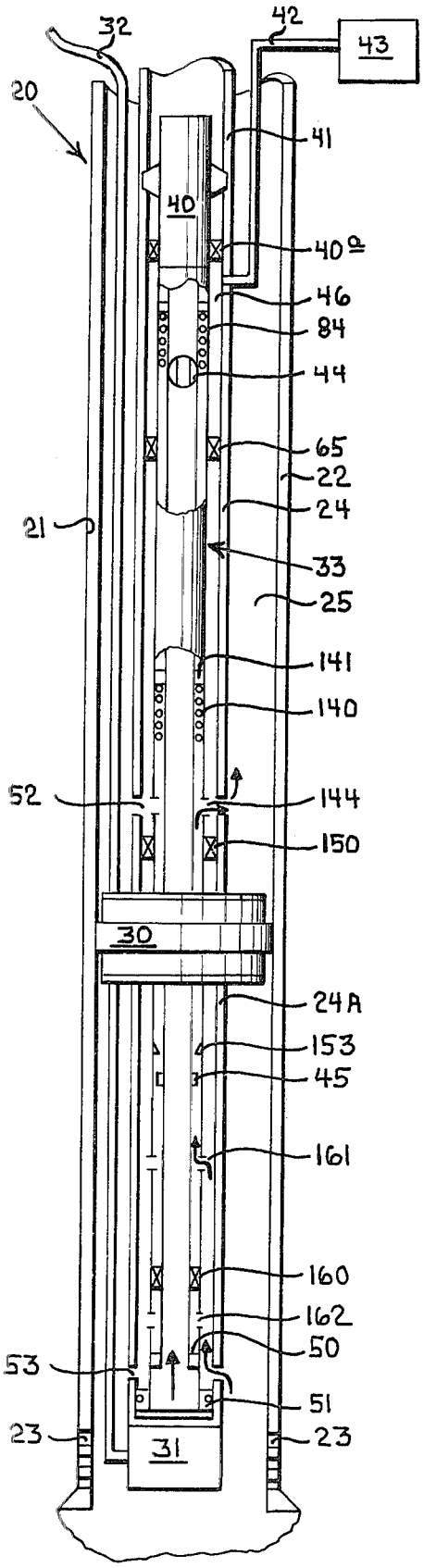
FIG. 1 is a longitudinal schematic view in section and elevation of an oil and gas well completion design employing a well safety valve embodying the features of the invention showing the safety valve in the open producing mode.

Referring to FIG. 1, a well completion design 20 for pumping an oil and gas well is shown in a producing mode in which oil is pumped through a producing string while gas separated from the oil flows up the well bore in the tubing-casing annulus. The well bore 21 is lined with a casing 22 provided with a plurality of perforations 23 for communication through the casing into an earth formation containing oil and gas. A production tubing string 24 is supported from a wellhead, not shown, at the surface for producing oil from the well. The annular space between the casing 21 and the tubing 24 defines an annulus 25 through which separated gas flows to the wellhead. The tubing string 24 connects in a suitable well packer 30 which forms a seal with the casing above the producing formation. A lower tubing string 24A is connected into the lower end of the packer supporting a pump 31 secured on the lower end of the lower tubing string. An electric cable 32 extends from the wellhead along the tubing string through the packer to the pump 31 for conducting electric power to the pump. A safety valve 33 for shutting off flow through the tubing string and the annulus from the producing formation is supported within the upper and lower tubing strings 24 and 24A through the packer 30 from a locking mandrel 40 which releasably locks the safety valve in the tubing string at a landing nipple section 41 of the tubing string. A hydraulic control line 42 is connected from the tubing string at the safety valve through the casing annulus into a hydraulic control manifold 43 at the surface for remotely controlling the operation of the safety valve responsive to certain predefined safety considerations.

In accordance with the invention the retrievable safety valve 33 includes a fail-safe ball valve assembly 44 operated by hydraulic fluid from the line 42 for controlling the flow of pumped oil in the tubing string, an annulus bypass valve 45 for controlling gas flow along the casing annulus, a recirculating valve 50 for controlling well fluids recirculation when the safety valve is closed, and a lower end seal 51 for sealing with the inner wall of the tubing at the lower end of the safety valve above the pump. The upper tubing string above the packer includes side ports 52 for flow of gas from the tubing string into the annulus 25 above the packer. The lower tubing string 24A has side ports 53 above the bottom seal 51 for admitting separated gas in the annulus into the tubing string for upward flow through the packer to the exit ports 52 above the packer.

Figure 2:
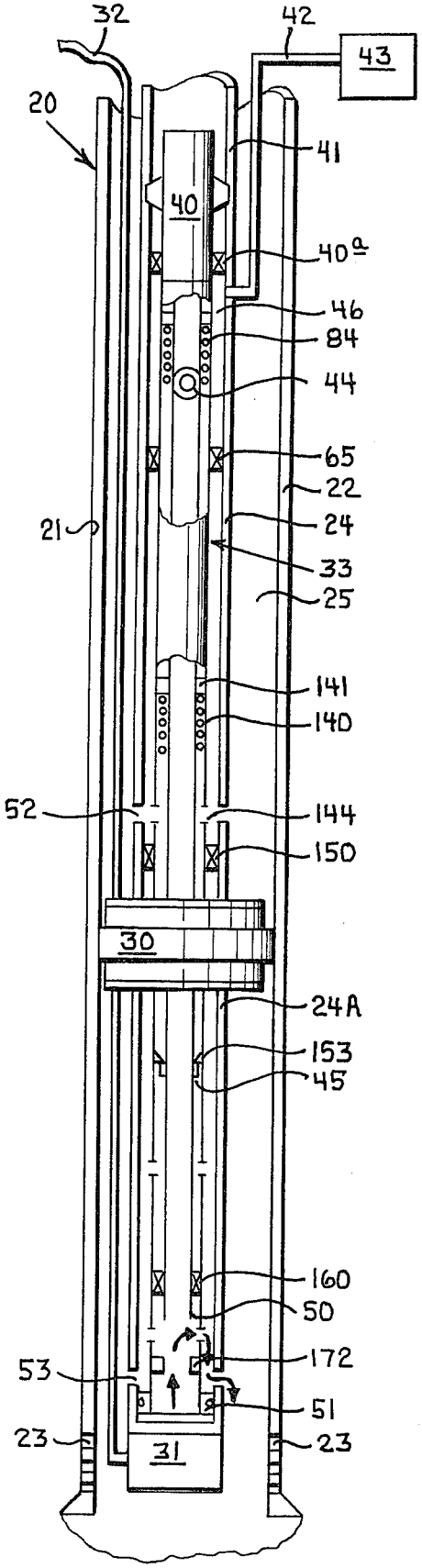
FIG. 2 is a longitudinal schematic view in section and elevation of the well completion design of FIG. 1 showing the well safety valve of the invention in the closed recirculating mode.

When the well safety valve 33 is in the producing mode as illustrated in FIG. 1, the ball valve assembly 44 is open permitting the pump 31 to pump oil upwardly from the producing formation through the packer to the surface through the tubing string 24. The annulus bypass valve 45 is open and the recirculating valve 50 is closed directing the flow of separated gas in the casing annulus below the packer from the inlet ports 53 along the safety valve body passages through the packer to the exit ports 52 into the casing annulus above the packer. When the well safety valve is in the shut-in or non-producing mode as illustrated in FIG. 2, the ball valve assembly is closed, the annulus bypass valve is closed, and the recirculating valve is open thereby preventing flow of oil and gas in the tubing string and the casing annulus to the surface while permitting continued operation of the pump 31 which recirculates the oil and gas in the casing below the packer. The oil and gas taken into the lower end of the pump is discharged from the upper end of the pump into the tubing string and back into the casing annulus below the packer through the ports 53. It is therefore not necessary to turn off the pump when the well is shut-in by the safety valve.

In the well completion design 20, the hydraulic control manifold 43, the locking mandrel 41, the packer 30, and the pump 31 are conventional available units regularly employed in the oil and gas industry for producing wells. A hydraulic control manifold which may be used is illustrated and described in the Wireline Catalog of Otis Engineering Corporation, supra, at pages 68–70. Locking mandrels which may be used are also illustrated in such catalog at page 14. A typical packer which may be used in the completion design is shown at page 116 of Otis Engineering Corporation Catalog Number 5120B entitled PACKERS published in 1979. A variety of electric well pumps are available from different manufacturers. The upper and lower tubing strings 24 and 24A include the necessary tubing sections such as standard couplings, tubular extensions, ported nipples, and other conventional tubular parts, not shown but rather schematically illustrated in FIGS. 1 and 2, for suitably connecting the upper tubing string into the packer and for connecting and supporting the pump from the lower end of the packer. For example, the landing nipple 41 is a standard tubing string fitting for receiving and supporting the locking mandrel 40 and, similarly, the side ports 52 and 53 are provided in ported tubing sections connected into the tubing strings. The landing nipple includes a standard side fitting for connecting the lower end of the hydraulic control line 42 into the nipple to conduct hydraulic control fluid to the well safety valve.

The well safety valve 33 of the invention as shown in specific structural detail in FIGS. 3A–3D includes an outer tubular housing and a concentric inner tube formed of a plurality of parts more specifically described defining a central longitudinal flow passage for pumped oil controlled by the ball valve assembly 44 and an annular separate flow passage between the inner tube and the body for separated gas controlled by the bypass valve 45. The central tube assembly is longitudinally movable within the body for operating both the ball valve assembly and the bypass valve. Referring specifically to the drawings, the safety valve body includes a top sub 54 which has an internally threaded upper end portion 55 for connection of the safety valve with the lower end of the locking mandrel 40. The top sub is threaded into the upper end of the body housing 60 which has a side port 61 for hydraulic control fluid. The body 60 has an internal annular flange 62 providing an annular spring stop shoulder 63. A tubular packing mandrel 64 is threaded into the lower end of the body 60. An O-ring seal 65 supported in an internal annular recess of the lower end portion of the body 60 seals between the body 60 and the packing mandrel. The packing mandrel has a reduced portion **64*a* on which a packing assembly 65 is mounted between a stop shoulder 70 on the packing mandrel and the end edge 71 of the body 60. The packing assembly 65 seals between the safety valve body and the inner wall of the tubing string 24 when the safety valve is in operating position in the tubing string. The packing mandrel 64 is provided with an internal annular tapered seat surface 72 which performs a limiting function in the operation of the ball valve assembly. A body member 73 is threaded along an end portion to the packing mandrel 64 enclosing the ball valve assembly 44 of the safety valve. A tubular hydraulic piston and ball valve operator tube 74 is slidably mounted within the body members 60 and 73 and the seal mandrel 64 for longitudinal movement within the body to open and close the ball valve assembly 44 responsive to hydraulic pressure and spring force. The upper end portion of the piston and operator tube telescopes into the top sub 54. An O-ring seal 75 in an internal annular recess within the top sub seals between the top sub and the outer surface of the operator tube. An external annular flange defining a piston ring 80 is formed integral with the operator tube spaced from the upper end of the tube. An O-ring seal 81 is positioned within an external annular recess of the piston ring flange for sealing around the flange with the inner wall surface of the body member 60. The piston and operator tube 74 is concentrically spaced within the body member 60 defining a variable hydraulic fluid cylinder 82 above the piston ring 80 and a variable annular cylinder 83 below the piston ring 80. A closing spring 84 is positioned within the annular cylinder 83 around the tube 74 between the stop shoulder 63 and the bottom surface of the piston ring 80 for biasing the tube 74 upwardly to close the ball valve assembly 44. Hydraulic fluid introduced in the annular cylinder 82 through the port 61 forces the piston and operator tube 74 downwardly for opening and holding the ball valve assembly open. The ball valve 44 is operated by the tube 74 in a valve assembly illustrated in detail in FIGS. 3B and 5–12. Referring to such drawings, the ball valve assembly includes an upper seat 85, the ball valve 44, a split sleeve type housing or cage 88 formed by two half-cylinder members 89, a lower seat 90, and a pair of control arms 91. Referring to FIGS. 3B, 5, and 6, the upper valve seat 85 has a tubular body portion 86 provided with a tapered external end seat surface 92 for engagement with the seat surface 72 on the mandrel 64 and an internally threaded portion 93 connectable on the threaded end portion of the operator tube 74 for coupling the ball valve assembly with the operator tube. The upper valve seat 85 has a reduced central portion 94 provided with an external annular coupling recess 95 for connecting the ball valve control arms 91 with the upper seat. As shown particularly in FIG. 5, the end of the upper seat at the ball valve has an internal annular seat surface 100** designed to mate with the spherical surface of the ball valve.

The periphery of the end of the upper seat 85 at the ball valve is flanged as shown in FIGS. 5 and 6 shaped to provide two oppositely disposed guide lugs 101 which engage longitudinal slots in the valve assembly cage 88 and also two pairs of oppositely disposed smaller pairs of ears 102 each spaced to define a control arm guideway 103. The ball valve 44, formed from spherical stock, has a bore 104 for fluid flow when the valve is open and flat opposite side surfaces 105 which are parallel with each other and with the longitudinal axis of the bore 104. The ball valve has mounting pin holes 110 formed through the centers of the opposite flat sides 105 along an axis through the centers of the flat sides along the center line of the ball valve through and perpendicular to the axis of the bore 104 so that the ball valve is rotatable between open and closed positions on mounting pins on the control arms 91. The ball valve is also provided with milled operator pin slots 111, as shown in FIGS. 5 and 7, for operator pins secured with the cage 88. The ball valve operator arms 91, as illustrated in FIGS. 8 and 9, each includes a rectangular body 112 provided along one end with an internal coupling flange 113 and near the other end with an internal pivot pin 114. The flange 113 fits within the recess 95 of the upper valve seat 85; the body 112 extends through the guideway 103 of the upper seat; and the pivot pin 114 fits within a bore 110 of the ball valve 44. Two control arms are employed, one along each of the opposite sides of the upper seat and the ball valve pivotally connecting the ball valve member with the upper seat within the cage. The cage 88, as shown in FIGS. 10 and 11, is formed of two half-cylinder members 89 machined with tubular stock to provide a 3-step bore having a large end section 120, an intermediate smaller section 121, and a still smaller opposite end section 122. The bore portion 122 provides the cage with an internal locking flange 123 for longitudinally interlocking the cage with the lower seat 90. The stock from which the cage is made is cut longitudinally to form the two members 89 as seen in FIG. 11. Each member 89 is provided with an internal ball valve operator pin 124 and an internal guide pin 125. The pins 124 and 125 are aligned in spaced relation along a line extending perpenicular to the longitudinal axis of the cage as evident in FIG. 10. Each of the cage members 89 has longitudinal slots 130 on opposite sides of each member opening inwardly so that when the two cage members are fitted together in the relationship of FIG. 11, the slots 130 opening together on each side of the cage define a longitudinally extending rectangular slot along each side of the cage member for the guide lugs 101 of the upper valve seat 85. The cage members 89 fit together within the body member 73 around the upper valve seat 85, the ball valve 44 and the ball valve control arms 91, and the lower seat 90. The internal flange portion 123 of each of the cage members 89 fits within an external angular coupling recess 131 provided along the upper end portion of the lower valve seat 90. The coupling of the cage with the lower valve seat limits longitudinal movement of the cage relative to the lower valve seat. The guide lugs 101 of the upper valve seat within the longitudinal slots 130 of the cage members allow the upper valve seat limited longitudinal movement relative to the cage. The ball valve 44 fits within the bore portion 121 of the cage. The ball valve control arms 91 are positioned along opposite sides of the upper valve seat and the ball valve coupled with the upper valve seat by the internal coupling flanges 113 of the arms which fit within the coupling recess 95 of the upper seat. The body 112 of each control arm extens through a guideway 103 of the upper seat into the cage 88 along the opposite flat sides 105 of the ball valve between the pins 124 and 125 of the members 89 of the cage. The pins 114 of the control arms fit into the pivot holes 110 of the ball valve. The control pins 124 of the cage members 89 each fit within the adjacent operator pin slot 111 of the ball valve. The inward flat end of each pin 125 fits in close spaced relation with the ball valve flat surface 105 so that the two pins 125 maintain the alignment of the ball valve as the ball valve rotates on the pivot pins 114 of the control arms. Longitudinal movement of the upper valve seat, the control arms, and the ball valve as a unit relative to the cage causes rotation of the ball valve due to relative movement between the pivot pins 114 and the pivot holes 110 of the ball valve and the control pins 124 in the cage fitting in the slots 111 of the ball valve. The cage movement is substantially less than the ball valve so that the pins 124 rotate the ball valve about 90 degrees on the pins 114 between open and closed positions.

Referring to FIG. 3B, a tubular spring housing section 131 is threaded along a reduced upper end portion 132 into the lower end of the tubular body member 73. An operator tube 133 for opening and closing the annulus bypass valve 45 and the recirculating valve 50 is concentrically position within the housing section 131. The upper end portion of the operator tube 133 is threaded into the lower ball valve seat 90. An O-ring seal 134 in an internal annular recess within the end portion 132 of the housing section 131 seals between the housing section and the operator tube 133. An annular space 135 is defined between section 131 and the operator tube 133. A spring 140 is positioned within the annular space 135 for urging the operator tube upwardly. The upper end of the spring bears against a shoulder ring 141 secured on the operator tube 133 so that the spring urges the operator tube upwardly. The lower end of the spring bears against the upper end of a tubular housing and spring retainer 142, which is threaded along an upper end portion into the lower end portion of the housing section 131. A side port 143 through the housing section 131 into the annular space 135 vents the annular space through the housing to prevent entrapment of fluid within the housing around the spring. The operator tube 133 extends in concentric spaced relation through the retainer 142, defining an annular gas bypass passage 143 between the retainer and the operator tube. A side port 144 is provided in the retainer 142 for flow of bypass gas back into the well bore. A tubular lower packing mandrel 145 is threaded into the lower end of the retainer 142 in spaced relation around the operator tube 133. An external annular packing assembly 150 is supported on the mandrel 145 between a shoulder 151 on the mandrel and the lower end 152 of the retainer 142. The packing assembly 150 seals around the safety valve housing within the tubing string 32 when the safety valve is in operating position within the tubing string as represented in FIGS. 1 and 2. The mandrel 145 is spaced from the operator tube 133 defining an annular space 152 between the tube and the mandrel for upward flow of bypass gas. The lower end portion of the bore of the mandrel 145 is enlarged providing a downwardly and outwardly tapered bypass valve seat surface 153 for coacting with the bypass valve 45 to control the flow of bypass gas in the valve housing along the operator tube to the side port 144. A tubular bypass adapter 154 is threaded along an upper end portion on the lower end portion of the mandrel 145 providing a housing around the bypass valve 45 and the recirculating valve 50. The adapter 154 has an internal annular seal flange 155 supporting an O-ring seal 160. The adapter 154 has a side port 161 providing an inlet into the valve housing for bypass gas. Below the seal flange 155, the adapter 154 has side ports 162 for recirculating fluids. A valve tube 163 having an enlarged upper end portion 164 is threaded on the lower end of the operator tube 133. The annular bypass valve 45 is formed on the upper end of the valve tube 163 while the annular recirculating valve 50 is provided on the lower end of the valve tube 163. The lower end portion of the mandrel 145 and the adapter 154 are concentrically spaced around the lower end portion of the operator tube 133 and the valve tube 163, defining an annular gas bypass passage 165 above the ring seal 160 and an annular recirculating passage 170 below the ring seal 160. The recirculating valve 50 on the lower end of the valve tube 163 seats on concentric rings 171 and 172, held by an internal annular retainer flange 173 in the adapter 154 against the upper end edge of a tubular extension sub 174 threaded into the lower end portion of the adapter 154. An O-ring seal 175 is confined in an annular recess in the upper end of the sub 174 by the ring 172 as shown in FIG. 3C. Referring to FIG. 3D, an extension tube 180 is secured by a connector 181 to a reduced lower end portion 182 of the sub 174. The seal assembly 51 is secured on the lower end of the extension tube 180. The seal assembly 51 includes a tubular packing mandrel 183 threaded on the lower end of the tube 180, V-packing 184 on the packing mandrel, and a packing retainer ring 185 holding the packing 184 on the mandrel 183. The packing assembly 51 seals with the inner wall of the lower tubing string section 24A above the pump 31 as shown in FIGS. 1 and 2.

The completion stage of an oil and gas well as illustrated in FIGS. 1 and 2 includes surface assembly of the pump 31, the packer 30, and the electric cable to the pump, the tubing string sections 24A connecting the pump with the packer, the tubing string 24 including the landing nipple section 41 connected into the packer, and the hydraulic line 42 connected into the landing nipple section. The pump and cable, the packer, and the connecting tubing string sections are run to location by means of the tubing string 24, and the packer is set hydraulically by conventional techniques. The safety valve 33 is then connected with the locking mandrel 40 and run on a wireline from the surface through the string 24 to the location illustrated in FIGS. 1 and 2. The locking mandrel releasably locks at the landing nipple 41 supporting the safety valve through the packer with the seal assembly 51 of the safety valve engaged with the inner wall of the tubing string below the packer and between the pump 31 and the bypass inlet ports 53 in the tubing string. Also, sealing with the inner wall of the tubing string are the valve housing seal assemblies 65 and 150. The seal assembly 65 on the valve housing and a seal assembly **40*a* on the locking mandrel define an annular space 46 around the valve housing within the tubing string for directing the hydraulic control fluid from the line 40 into the side port 61 of the valve housing for hydraulic control of the safety valve. The seal assembly 150 engages the inner wall of the tubing string in the vicinity of the packer 30 below the tubing port 52 above the packer directing bypass gas outwardly through the port 52 into the casing-tubing annulus 25 above the packer. At the surface, the electric line 32 is connected with a suitable source of electric power, not shown, for operating the pump 31. The hydraulic control line 42 is connected with the hydraulic control manifold 43 for supplying hydraulic fluid under a controlled pressure to the safety valve for operating the valve. The hydraulic pressure in the line 42 holds the safety valve 33** open for well production. A reduction in such hydraulic pressure by way of damage to the surface system or by response of the control manifold to a change in operating condition, such as temperature and the like, allows the control pressure to drop to a level at which the operating springs of the safety valve close the valve.

The safety valve 33 is a normally closed valve which means that when there is no pressure in the hydraulic control line 42, or such control pressure is below a predetermined level depending upon the valve closing spring 84, the ball valve 44 is closed preventing upward flow in the tubing string 24, the annulus bypass valve 45 is closed preventing upward flow of separated gas in the tubing-casing annulus, and the recirculating valve 50 is open allowing continuous operation of the pump 31 recirculating the pumped well fluids back into the well bore from the tubing below the packer. FIGS. 2 and 4A–4C, show the safety valve closed. When the safety valve is open the ball valve 44 is open allowing the pump to pump well fluids upwardly through the valve into the tubing string 24, the annulus bypass valve 45 is open allowing upward flow of separated gas into the tubing-casing annulus above the packer, and the recirculating valve 50 is closed preventing recirculation of well fluids by the pump back into the well bore below the packer. FIGS. 1 and 3A–3D inclusive show the safety valve open.

For purposes of describing the operation of the safety valve 33 it shall be assumed that initially the valve is closed prior to production of the well by means of the pump 31. Referring specifically to FIGS. 2 and 4A–4C, the safety valve is opened by increasing the hydraulic pressure from the control manifold 43 to the valve through the line 42. The pressure increase is communicated into the annular space 46 within the tubing string 24 between the locking mandrel seal 40*a* and the safety valve seal 65. The pressure increase is communicated from the tubing annulus around the valve into the valve housing through the side port 61 leading into the annular cylinder chamber 82 above the piston ring 80. When the force of the pressure on the piston ring 80 exceeds the resistance of the springs 84 around the annular piston 74 and 140 around the operator tube 133, the annular piston 74 is forced downwardly compressing the spring 84 and moving the upper ball valve seat 85 connected on the lower end of the tube 74 downwardly relative to the cage 88. The lugs 101 on the upper valve seat move downwardly in the slots 130 of the cage until the lower ends of the lugs engage the lower ends of the slots. As the upper valve seat moves downwardly the ball valve control arms 91 and the ball valve 44 are moved downwardly in the cage. The operator pins 124 in the cage members 88 engage the ball valve recesses 111 so that as the ball valve is forced downwardly relative to the pins 124 the ball valve is rotated on the pivot pins 114 of the control arms turning the ball valve from the closed position of FIG. 4A to the open position of FIG. 3B. When the lugs 101 on the upper valve seat engage the lower end of the slots 130 of the cage members, the cage members are forced downwardly moving the lower seat 90, the extension tube 133, and the valve tube 163 downwardly compressing the spring 140 until the recirculating valve 50 on the lower end of the tube 163 seats on the rings 171 and 172 thereby closing the recirculating valve. The bypass 45 is moved downwardly from the valve seat 153 opening the bypass valve as shown in FIG. 3C. The dimensions of the ball valve assembly parts, the cage members 89, the lower valve seat 90, and the tubes 133 and 163 are selected to insure that the recirculating valve 50 on the lower end of the tube 163 will fully seat in closed position before the lower end of the lower seat 90 shoulders on the upper end of the housing member 131. The downward movement of the tubes 133 and 163 compress the spring 140 confined between the shoulder ring 141 in the upper end of the spring retainer 142. Thus, with the valve 33 open both of the springs 84 and 140 are compressed.

The hydraulic control pressure in the line 42 holds the valve 33 open as represented in FIGS. 1 and 3A–3D. Operation of the pump 31 is controlled through the electric cable 32. Well fluids entering the well through the ports 23 around the pump and tubing string below the packer are drawn into the pump and discharged upwardly through the central bore of the safety valve 33. The pumped fluids flow through the seal assembly 51, the extension sub 174, the valve tube 163, the operator tube 133, the open ball valve 44, the operator tube 74, and through the top sub 54 and the locking mandrel 40 into the tubing string 24 through which the fluids flow to the surface. Separated gas in the annular space within the casing around the tubing string below the packer 30 flows into the tubing string through the side ports 53 above the lower packing assembly 51. The gas flows upwardly in the tubing string above the packing assembly to the side ports 161 in the bypass adapter 154. The bypass gas flows along the annular space 165 between the tube 163 and the adapter 154 past the valve 145 and through the valve seat 153 into the annular passage 152. The bypass gas continues from the annular passage 152 into the annular passage 143 and outwardly through the side ports 144 in the tubing string into the tubing-casing annulus 25 above the packer 30. The bypass gas then flows in the tubing-casing annulus to the surface. Thus, the pumped well fluids flow upward through the open ball valve 44 of the well safety valve 33 while the separated bypass gas flows along annular flow passages in the safety valve body past the well packer 30 and into the tubing-casing annulus.

The hydraulic manifold 43 at the surface may be operated to stop producing the well when desired or the control manifold may function in response to damage at the wellhead or some operating condition such as excessive temperature to stop well production. When the control manifold is operated either intentionally or through response to a change in well condition the hydraulic pressure is lowered in the control line 42 leading through the tubing string below the locking mandrel 40 into the annular cylinder 82 through the side ports 61 in the housing 60 of the safety valve. Referring to FIGS. 2 and 4A–4C, when the hydraulic control pressure in the annular cylinder 82 is reduced below a predetermined level, the springs 84 and 140 begin expanding upwardly lifting the ball valve operator tube 74 and the tubes 133 and 163 controlling the bypass valve 45 and the recirculating valve 50. The ball valve and bypass and recirculating valve structure associated with the tubes 74, 133, and 163 initially moves up simultaneously until upper ends of the ball valve cage members 89 engage the lower end edge 66 of the packing mandrel 64 which stops the upper movement of the cage members 89, the lower valve seat 90 coupled with the cage members, and the tubes 133 and 163 being lifted by the spring 140. During the upward movement of the valve parts prior to the upper ends of the cage members 89 engaging the lower end of the packing mandrel, the ball valve may begin closing but full closure is not effected until after the upward movement of the cage members and those parts connected to them is stopped by engagement of the cage members with the lower end of the mandrel 66. The spring 84 then continues lifting the operator tube 74, the upper ball valve seat 86, the ball valve control arms 91, and the ball valve 44. As the upper valve seat pulls the control arms and the ball valve upwardly relative to the surrounding cage members 89 which are now stopped, the upward movement of the ball 44 relative to the control pins 124 in the cage members which are not moving and which are engaging the slots 111 in the ball valve rotate the ball valve on the pivot pins 114 to the closed position shown in FIG. 4A. The upward movement of the tube 163 effected by the expansion of the spring 140 closes the bypass valve 45 which seats on the surface 153 shutting off upward flow of bypass gas into the annular passage 152 from the bypass gas inlet ports 161 in the safety valve housing so that no bypass gas may flow upwardly through the safety valve above the packer 30. Simultaneously the upward movement of the tube 163 opens the recirculating valve 50 which is lifted to a position shown in FIG. 4C spaced above the valve seat rings 171 and 172. The ball valve 44 is closed, the bypass gas valve 45 is closed so that no well fluids may be pumped upwardly and bypass gas may not flow upwardly while the recirculating valve 50 is open. The well pump 31 may continue to operate discharging well fluids including both liquid and gas upwardly into the lower end portions of the safety valve housing through the valve seats 171 below the ring seal 160 and outwardly through the side ports 162 back into the tubing-casing annulus below the packer 30. The path followed by the pumped recirculating well fluids from the well bore through the pump into the lower end of the well safety valve and back into the well bore through the side ports 162 is illustrated in FIG. 2.

When well production by pumping is again desired the pressure of the hydraulic control fluid in the line 42 is again raised to reopen the ball valve 44 and the gas bypass valve 45 while closing the recirculating valve 50 to permit pumping well fluids upwardly in the tubing string and the flow of bypass gas upwardly in the tubing-casing annulus as previously described.

What is claimed is:

1. A well safety valve comprising: a longitudinal valve housing; means in said housing defining a longitudinal central flow passage and a separate longitudinal annular flow passage; valve means in said central flow passage; valve means in said annular flow passage; recirculating valve means between said central and said annular flow passage; and means coupled with said valves for simultaneously opening said recirculating valve and closed both said central and said annular flow passage valves and for simultaneously closed said recirculating valve and opening both said central and said annular flow passage valves.

2. A well safety valve in accordance with claim 1 wherein each of said valve means is remotely controllable.

3. A well safety valve in accordance with claim 2 wherein said valve means are operable responsive to hydraulic fluid pressure.

4. A well safety valve in accordance with claim 3 wherein said valve means in said central flow passage is a ball valve and said valve means in said annular flow passage and said recirculating valve means are longitudinally spaced each from the other and from said ball valve and comprise an annular valve member and an annular valve seat.

5. A well safety valve in accordance with claim 4 wherein said ball valve is connected with and operates each of said annular valves by a central control tube defining said central flow passage through said valve housing.

6. A well safety valve in accordance with claim 5 wherein said valve housing is connectible with a wireline operable locking mandrel.

7. A well safety valve in accordance with claim 6 including longitudinally spaced annular seals on said housing for sealing around said housing with the inner wall of the tubing string and means defining a side port in said housing between said seals leading to said annular flow passage up stream from said annular valve in said annular flow passage, said recirculating valve is up stream of said annular valve in said annular flow passage, and a side port between said recirculating valve and said annular valve in said annular flow passage leading into said annular flow passage.

8. A well safety valve in accordance with claim 7 including a hydraulic cylinder in said housing connected with said ball valve for biasing said ball valve open and spring means in said housing connected with said control tube for biasing said ball valve and said annular valve in said annular flow passage closed and said recirculating valve open.

9. A well safety valve in accordance with claim 8 including an external annular seal along an end portion of said housing up stream from said recirculating valve for sealing with the inner wall of a well tubing around said housing.

10. A well safety valve in accordance with claim 9 including an annular seal around said control tube within said valve housing between said annular valve in said annular flow passage and said recirculating valve and a side port in said valve housing between said annular seal and said recirculating valve.

11. A safety and recirculating valve for an oil and gas well completion equipped with a submergible pump comprising: a tubular housing adapted to be connected in a production well tubing string in said well above a submergible pump supported by said tubing string; said housing having means defining a longitudinal central flow passage for pumped well fluids and a separate longitudinal annular flow passage for bypassing gas through a well packer around said tubing string between casing annuli above and below said packer; valve means in said central flow passage; bypass valve means in said annular flow passage; recirculating valve means between said central and said annular flow passages; valve operator means in said housing coupled with said central flow passage valve means, said bypass valve means, and said recirculating valve means for substantially simultaneously opening said central flow passage and said bypass valve means and closing said recirculating valve means and substantially simultaneously closing said central flow passage and said bypass valve means and opening said recirculating valve means; and port means in said housing communicating with said bypass valve means for directing bypass gas along said annular flow passage through said bypass valve means for bypass gas flow through said packer and for directing recirculating well fluids from said pump along said central flow passage and said annular flow passage through said recirculating valve means below said packer.

12. A well valve in accordance with claim 11 including means for connecting said housing with means for releasably locking said valve in said tubing string and annular seal means on said housing for sealing around said housing with said tubing string to direct well fluids to and from said port means in said housing.

13. A well valve in accordance with claim 12 wherein said valve operator means includes remote control means.

14. A well valve in accordance with claim 13 wherein said remote control means is hydraulically operable.

15. A well valve in accordance with claim 14 wherein said central flow passage valve means is a ball valve and said bypass and said recirculating valve means are annular valve and seat assemblies.

16. A well valve in accordance with claim 15 wherein said valve operator means includes an operator tube connected from said ball valve to said bypass and said recirculating valve means and spring means coupled with said operator tube for closing said ball valve and said bypass valve means and opening said recirculating valve means when hydraulic fluid pressure communicated to said valve operator means drops below a minimum value.

17. A well valve in accordance with claim 16 including an annular hydraulically operable piston connected with said ball valve for opening said ball valve and said bypass valve means and closing said recirculating valve means.

18. A well valve in accordance with claim 17 wherein the said annular seal means on said housing includes an upper seal, a middle seal, and a lower seal, and said port means includes a first port in said housing between said upper and said middle seals for exit of bypass gas from said annular flow passage in said housing, a second port in said housing between said bypass valve and said recirculating valve for inlet of bypass gas into said annular flow passage, and a third port in said housing above said recirculating valve for exit of pumped well fluids from said housing when said recirculating valve is open.

19. A safety and recirculating valve for an oil and gas well completion design including a submergiful pump comprising: a tubular housing having means at a first end for connection with a locking mandrel for releasably locking said valve at a landing nipple in a well tubing string; said housing having means defining a longitudinal central flow passage for pumped well fluids and a concentric annular flow passage around said central flow passage for flow of gas separated from said pumped well fluids; longitudinally spaced upper, middle and lower end external annular seals on said housing for sealing around said housing with the inner wall of said well tubing string; means providing a first side port through said housing into said annular flow passage between said upper and said middle seals for exit of gas from said annular flow passage; means providing a second port in said housing between said middle and said lower end seals for inlet of gas into said annular flow passage; means providing a third port in said housing into said annular flow passage between said second port and said lower end seal for recirculation of well fluids from said central flow passage through said housing into a well casing annulus around said housing; a ball valve along said central flow passage rotatable to open and close said valve for controlling flow of pumped fluids through said central flow passage; a longitudinally movable operator tube along said central flow passage connected with said ball valve for opening and closing said ball valve; said operator tube and said housing being concentrically spaced defining an annular cylinder between said housing and said operator tube; an annular piston formed on said operator tube and movable in sealed relationship in said housing along said annular cylinder for responding to hydraulic pressure in said cylinder for moving said operator tube to open said ball valve; means defining a side port in said housing between said first end of said housing and said upper seal for directing hydraulic fluid into said annular cylinder; a spring in said annular cylinder on the opposite side of said annular piston from said side port into said cylinder, said spring engaging said piston for moving said operator tube to close said ball valve; an extension tube along said central flow passage connected at a first end with said ball valve on the opposite side of said ball valve from said operator tube; a valve tube threaded along a first end to the second end of said extension tube; said extension tube and said valve tube being concentrically spaced within said housing defining said annular flow passage within said housing around said extension tube and said valve tube along said housing extending from between said upper and said middle annular seals on said housing to a location between said middle and said lower end seals on said housing; means defining an internal annular bypass valve seat in said housing around said extension tube between said first and said second ports through said housing into said annular flow passage; an external annular valve formed on said first end of said valve tube longitudinally movable relative to said bypass valve seat in said housing for permitting bypass gas flow along said annular passage when said bypass valve is longitudinally spaced from said bypass valve seat and for shutting off flow of bypass gas along said annular flow passage when said bypass valve is seated on said bypass valve seat; an internal annular seal in said housing around said valve tube between said second and said third ports in said housing; an internal annular recirculating valve seat in said housing between said third port in said housing and the second lower end of said housing; a bypass valve on the second end of said valve tube for engaging said recirculating valve seat when said valve tube is at a first lower end position closing said recirculating valve and for movement to a second upper end position spaced from said recirculating valve seat at which said bypass valve is seated on said bypass valve seat for admitting pumped well fluids from said central flow passage to said third side port in said housing when said ball valve and said bypass valve are closed; said extension tube being concentrically spaced within said housing along a central portion thereof defining an annular chamber in said housing around said extension tube; an external annular stop shoulder on said extension tube within said annular chamber around said tube; and a spring in said annular chamber engaged with said stop shoulder for urging said extension tube in a direction to close said bypass valve and open said recirculating valve.

20. A well safety and recirculating valve in accordance with claim 19 including an upper ball valve seat secured on said operator tube between said operator tube and said ball valve; control arms on opposite sides of said upper ball valve seat connected with said ball valve along the axis of rotation of said ball valve; an annular ball valve cage around said ball valve having ball valve operator pins engaging said ball valve at eccentric positions for rotating said ball valve responsive to relative motion between said upper ball valve seat and said cage; and a lower ball valve seat connected between said cage and said first end of said extension tube.

* * * * *